US012618213B2

(12) United States Patent
Sun et al.

(10) Patent No.: US 12,618,213 B2
(45) Date of Patent: May 5, 2026

(54) SMOOTH AUTOMATIC DEVICE AND METHOD FOR RESERVOIR SEDIMENT FLUSHING

(71) Applicant: ZHEJIANG UNIVERSITY, Hangzhou City (CN)

(72) Inventors: Yizhi Sun, Hangzhou City (CN); Zhilin Sun, Hangzhou City (CN); Hehe Zhu, Hangzhou City (CN)

(73) Assignee: ZHEJIANG UNIVERSITY, Hangzhou City (CN)

( * ) Notice: Subject to any disclaimer, the term of this patent is extended or adjusted under 35 U.S.C. 154(b) by 178 days.

(21) Appl. No.: 18/419,560

(22) Filed: Jan. 23, 2024

(65) Prior Publication Data

US 2024/0271381 A1 Aug. 15, 2024

(30) Foreign Application Priority Data

Feb. 14, 2023 (CN) ..... 202310116125.X

(51) Int. Cl.
*E02B 8/02* (2006.01)
*E02B 8/04* (2006.01)

(52) U.S. Cl.
CPC ..... *E02B 8/045* (2013.01)

(58) Field of Classification Search
CPC ..... G01M 99/00; E02B 3/041; E02B 3/023; E02B 8/045; E02B 8/02; E02B 1/00; E02B 8/026; Y02A 10/00; Y02E 10/20
See application file for complete search history.

(56) References Cited

U.S. PATENT DOCUMENTS 1,197,267 A * 9/1916 Cressy ..... E02B 3/023 210/170.1
2,961,782 A * 11/1960 Bos ..... E02F 7/065 37/321
3,013,395 A * 12/1961 Gaylord ..... B01D 21/2472 210/312

(Continued)

FOREIGN PATENT DOCUMENTS

CN 101353889 A 1/2009
CN 202007433 U * 10/2011

(Continued)

*Primary Examiner* — Edwin J Toledo-Duran
(74) *Attorney, Agent, or Firm* — Addison D. Ault; IPGentleman Intellectual Property Services, LLC

(57) ABSTRACT

This invention reveals a smooth automatic device and method for efficiently flushing sediment from a reservoir. It includes a sediment flushing funnel located at the reservoir dam's bottom, connected to a sediment flushing pipe. This pipe extends from the funnel's bottom through a smooth connecting pipe, horizontally through the dam, and then to the downstream river channel. Inside the funnel, a trigger-control mechanism is installed, linked to a sediment flushing ball valve within the sediment flushing pipe. The invention operates by automatically opening the ball valve when sediment accumulation in the funnel hits a preset threshold. The sediment is then released into the downstream river channel via the smooth connecting pipe and flushing pipe, driven by gravity. This system offers an effective solution for automatic reservoir sediment flushing, boasting high efficiency, energy conservation, and water resource savings.

8 Claims, 7 Drawing Sheets

(56) References Cited

U.S. PATENT DOCUMENTS 3,591,936 A * 7/1971 Van Geuns ..... E02F 9/045 405/203
3,620,371 A * 11/1971 Valdespino ..... B01D 29/114 210/195.3
3,638,432 A * 2/1972 Schoonmaker ..... E02B 3/023 37/335
3,975,842 A * 8/1976 Andreae ..... E02F 3/925 299/9
4,058,914 A * 11/1977 Kiss ..... E02F 3/9287 37/336
4,149,251 A * 4/1979 Noordermeer ..... G06G 7/22 37/308
4,401,576 A * 8/1983 Meurer ..... B01D 21/245 210/527
4,603,551 A * 8/1986 Wood ..... F03B 13/1855 60/497
4,604,000 A * 8/1986 van Weezenbeek .... E02F 5/287 37/344
4,685,828 A * 8/1987 Whittle ..... E02B 13/02 405/87
4,711,597 A * 12/1987 Odgaard ..... E02B 3/04 405/74
4,807,373 A * 2/1989 Sloan ..... E02F 3/8891 210/241
4,819,347 A * 4/1989 Lofgren ..... E02F 5/287 37/344
4,830,541 A * 5/1989 Shatto ..... E21B 41/08 405/226
4,943,186 A * 7/1990 Van Weezenbeek ..... E02F 3/9206 37/344
5,135,579 A * 8/1992 Goettl ..... E04H 4/12 134/169 R
5,143,623 A * 9/1992 Kroll ..... E02B 3/023 210/705
5,285,587 A * 2/1994 Krenzler ..... E02F 3/8833 37/344
5,421,105 A * 6/1995 Schulte ..... E02F 3/963 405/303
6,042,733 A * 3/2000 Tucker ..... E02B 3/023 405/74
6,112,439 A * 9/2000 Rinker ..... E02F 3/92 37/324
6,550,162 B2 * 4/2003 Price ..... E02F 5/28 37/317
7,226,242 B2 * 6/2007 LeBuffe ..... E02B 3/023 405/74
7,591,088 B1 * 9/2009 Schuh ..... E02F 3/885 37/317
7,621,059 B2 * 11/2009 McCoy, Jr. ..... E02F 3/907 37/317
7,943,039 B1 * 5/2011 LeBuffe ..... B01D 21/0021 405/74
8,522,459 B2 * 9/2013 Pavan ..... E02F 3/88 37/320
9,816,240 B1 * 11/2017 Tesvich ..... G01M 99/00
10,094,091 B1 * 10/2018 Tesvich ..... E02F 3/9293
10,967,301 B2 * 4/2021 Armbruster ..... B01D 21/0003
12,180,678 B2 * 12/2024 MacDonald ..... E02F 3/52
12,331,480 B2 * 6/2025 Chen ..... G05D 3/12
2002/0012571 A1 * 1/2002 Nichols ..... E02B 3/02 405/80
2005/0211607 A1 * 9/2005 Armbruster ..... B01D 21/245 210/519
2009/0084735 A1 * 4/2009 Taplin ..... E02F 3/8816 210/170.1
2009/0097920 A1 * 4/2009 Tucker ..... E02F 3/8808 405/74
2012/0067807 A1 * 3/2012 Lappeman ..... B01D 35/027 210/301
2013/0022399 A1 * 1/2013 Pierce, Jr. ..... E02B 3/04 405/31
2014/0369759 A1 * 12/2014 Lee ..... E02B 7/005 405/110
2018/0266383 A1 * 9/2018 Barg ..... F03B 15/08

FOREIGN PATENT DOCUMENTS

CN 107165120 A 9/2017
CN 107761658 A * 3/2018 ..... E02B 8/02
CN 110438938 A 11/2019
CN 112813918 A 5/2021
CN 113005983 A 6/2021
JP H10266171 A 10/1998
JP 2006118123 A 5/2006

* cited by examiner

SMOOTH AUTOMATIC DEVICE AND METHOD FOR RESERVOIR SEDIMENT FLUSHING

TECHNICAL FIELD

The present invention relates to the technical field of water conservancy project, in particular to a smooth automatic device and method for reservoir sediment flushing.

BACKGROUND ART

In many rivers there are the problems of high sediment concentration and large sediment discharge, that is, the problem of sediment deposition, is prominent and is one of the challenges for sediment control in the world. After the construction of a water retaining dam on the river to form a reservoir, the water level in the reservoir area is raised, the flow velocity is reduced, and the sediment carried by the water flow is accumulated in the reservoir area, in particular the sediment deposition in front of the dam is the thickest, which significantly reduces the effective capacity of the reservoir. In severe cases, it leads to reservoir siltation and waste.

Reservoir sedimentation not only reduces the capacity of the reservoir and shortens the service life, but also causes serious erosion of the downstream river channel due to the discharge of clear water, which destroys the downstream river ecological environment and the habitat of aquatic animals along the river. Meanwhile, the lack of fine-grained suspended matter in the water body results in a lack of biogenic materials and affecting the survival of aquatic animals.

Currently, the methods to solve the sediment deposition of reservoirs mainly include sediment discharge gate, sediment discharge around the reservoir, mechanical dredging and siphon sediment discharge, in addition to the three soil-and-water conservation measures, by siltation dam, terraced fields and forest-grass land. Wherein, the scouring sluice is opened when the density current occurs in the flood season, but the sand in unit water body is less than 15%. The scouring sluice is opened and closed by the electromechanical device, wasting water resources and electric energy. The scouring sluice is closed to store clear water after the flood season, and the scouring sluice is opened to discharge muddy water in the flood season, which is the scheduling method of clear-water-storage and muddy-water-discharge, and has been widely used in reservoir sediment flushing in China so far. The disadvantage is that a large amount of water is released during the flood season, resulting in a waste of water resources. In the circuitous method of sediment flushing, the sediment flushing pipe or tunnel is opened on the side of the reservoir to make the sediment bypass the reservoir dam and discharge into the downstream river channel. The sediment discharge efficiency of unit water body is not as good as that of density current, not suitable for reservoirs with long reservoir area or large reservoir capacity. Mechanical dredging requires a lot of energy and manpower, and the disposal of deposit is difficult, which is not suitable for large and medium-sized reservoirs. Siphon sediment flushing uses the downstream water head difference of the dam in the reservoir area to suck the sediment at the bottom of the reservoir into the pipeand discharge it outside, but the disadvantages are that the mechanical movement of suction head and the suction itself are time-consuming and energy-consuming.

SUMMARY

To solve the above problems, the present invention provides a smooth automatic device and method for reservoir sediment flushing, the combination of automatic sediment flushing and control methods provides a new idea for solving the problem of reservoir sedimentation, the smooth characteristics of gravity automatic sediment flushing function reduce the probability of device clogging, the sediment flushing control system does not require electric drive, which can significantly improve the efficiency of reservoir sediment flushing, save water resources and energy, and improve the ecological environment of downstream rivers.

To achieve the above purposes, the present invention provides a smooth automatic device for reservoir sediment flushing, including a sediment flushing funnel set at the bottom of the reservoir dam and a sediment flushing pipe connected to the bottom of the sediment flushing funnel through a smooth connecting pipe at one end, connected to the downstream river channel at the other end after passing through the reservoir dam horizontally;

a trigger-control mechanism is arranged inside the sediment flushing funnel, and a trigger-control mechanism connected with a sediment flushing ball valve is arranged inside the sediment flushing pipe.

Preferably, the trigger-control mechanism includes a vertical pipe set on the inner wall of the sediment flushing funnel and an upper piston assembly and a lower piston assembly set inside the vertical pipe, capable of vertically sliding, the lower piston assembly is connected to the top of the connecting rod, the bottom end of the connecting rod passes through the vertical pipe and is connected eccentrically with a first transmission gear, the first transmission gear and a second transmission gear are meshed, and the second transmission gear is linked to the sediment flushing ball valve;

the bottom of the vertical pipe is connected with the bottom of the clean-water pipe, and the top of the clean-water pipe is located in the clean water area of the reservoir;

the height of the vertical pipe's top is lower than the top height of the sand funnel's top.

Preferably, the upper piston assembly includes the upper piston body and the upper spring between the upper piston body and the inner wall of the sediment flushing funnel; a sealing ring is arranged between the upper piston body and the inner wall of the vertical pipe, which is used to keep the upper sediment of the upper piston body separate from the clean water lower, so that the pressure difference of the upper piston body is equal to the underwater weight of the sediment;

the lower piston assembly includes a lower piston body set below the upper piston body and a lower spring located between the lower piston body and the inner wall of the sand funnel;

the upper spring is inserted into the lower spring after passing through the center of the lower piston body.

Preferably, 3. the smooth automatic device for reservoir sediment flushing according to claim 2, wherein the transmission ratio $I_R$ of the first transmission gear and the second transmission gear is determined by the following formula:

$$I_R = \frac{2}{\pi}\arccos\left[\frac{h^2 - 2Lh}{2r(L + r - h)} + 1\right]$$

wherein, h is the set height of the lower piston body, l is the length of the connecting rod, ris the distance from the connecting rod to the center of the first transmission gear, $z_1$ is the number of teeth of the first transmission gear, and $z_2$ is the number of teeth of the second transmission gear; at the time that the piston body in the vertical pipe sliding down a distance h to the bottom and driving the first transmission gear rotation to rotate an angle α, the gear transmission ratio is $$I_R = \frac{2\alpha}{\pi},$$

so that the rotation angle of the sediment flushing ball valve equal to π/2 or 90°;

when the lower piston body slides downward in the vertical pipe to the bottom, it drives the first transmission gear to rotate an $\alpha_1$ angle, where the relation between $\alpha_1$ and the sliding height h of the lower piston body, the length L of the connecting rod, and the distance r between the end point of the connecting rod and the center of the first transmission gear, is described as:

$$\cos\alpha_1 = \frac{r^2 + (L + r - h)^2 - L^2}{2r(L + r - h)} = \frac{h^2 - 2Lh}{2r(L + r - h)} + 1$$

from which a new formula is deduced:

$$\alpha_1 = \arccos\left[\frac{h^2 - 2Lh}{2r(L + r - h)} + 1\right]$$

the relationship between the first gear rotation angle $\alpha_1$ and the second gear rotation angle $\alpha_2$ satisfies:

$$\alpha_2 = \frac{z_2}{z_1}\alpha_1 = \frac{z_2}{z_1}\arccos\left[\frac{h^2 - 2Lh}{2r(L + r - h)} + 1\right]$$

wherein, $\alpha_2$ is the rotation angle of the sediment flushing ball valve 90°.

Preferably, the elastic force $F_S(t)$ of the upper spring is equal to the underwater gravity of the sediment in the vertical pipe, that is:

$$F_S(t) = (\rho_S - \rho)\pi R^2 h(t)$$

wherein, R is the internal diameter of the vertical pipe or the radius of the upper piston body; h (t) is the deposition above the surface of the upper piston body, and it is a function of time t;

the maximum elastic force that the spring can withstand is:

$$F_{Smax} = k(\rho_S - \rho)\pi R^2 h_{max}$$

wherein, k is a parameter of the normal distributional funnel, set to be to 1.1~1.2, $h_{max}$ is approximately equal to H, $\rho_S$ is the density of accumulated sediment. ρ is the density of water, and H is the height of the mud surface from the bottom of the funnel.

Preferably, the linkage trigger heads that are capable of horizontally sliding are installed symmetrically at the upper end and the lower end of the vertical pipe, and the linkage trigger heads on the same side of at the upper and lower ends are connected by a linkage rod;

there is a limit allowance suitable for the upper piston body between the two linkage trigger heads at the top, and there is a limit allowance suitable for the lower piston body between the two linkage trigger heads at the bottom;

an extrusion spring is set between the linkage trigger head and the vertical pipe.

Preferably, the sediment flushing funnel is a normal distributional funnel, and the normal distributional funnel is formed by rotating a concave-distribution around the axis of axis;

The sediment flushing pipe is an inverse hyperbolic tangent pipe, and the central curve the inverse hyperbolic tangent pipe is an inverse hyperbolic tangent curve.

Both the normal distributional funnel and the inverse hyperbolic tangent pipe have arbitrary order of derivatives and have arbitrary degree of smoothness.

Preferably, the top of the smooth connecting pipe is tangent to the bottom of the normal distributional funnel, and the bottom of the smooth connecting pipe is tangent to the top of the inverse hyperbolic tangent pipe;

the smooth connection pipe adopts the following design: in the normal distributional funnel longitudinal section y=0, denote the single variable normal distribution function form corresponding to the normal distributional funnel as z=h(x), and denote the function corresponding to the curve at the entrance of the inverse hyperbolic tangent pipe as z=g(x), wherein, the normal distributional funnel surface and the entrance of the inverse hyperbolic tangent pipe are rotationally symmetrical with respect to the ordinate z; the slope at the normal distributional funnel outlet $(x_0, 0, z_0)$ is denoted as $h'(x_0)$, the slope of at the entrance of the inverse hyperbolic tangent channel $(x_1, 0, z_1)$ is $g'(x_1)$, wherein $|x_0|>|x_1|$, let $$C(x) = z_0 + h'(x_0)(x - x_0) + \beta_2(x - x_0)^2 + \beta_3(x - x_0)^3$$

wherein, $\beta_2$ and $\beta_3$ are the polynomial coefficients depending on the slopes $h'(x_0)$ and $g'(x_1)$, respectively:

$$\beta_2 = \frac{3(z_1 - z_0) - (x_1 - x_0)(2h'(x_0) + g'(x_1))}{(x_1 - x_0)^2}$$

$$\beta_3 = \frac{(h'(x_0) + g'(x_1))(x_1 - x_0) + 2(z_0 - z_1)}{(x_1 - x_0)^3}$$

The pipe body of the smooth connecting pipe is the rotationally symmetric surface z=C(x, y) obtained by rotating the curve C(x).

The smooth automatic method for reservoir sediment flushing includes the following steps:

S1. the reservoir sediment drops into a normal distributional funnel before reaching dam and, meanwhile, the sediment enters the vertical pipe and acts on the upper surface of the upper piston body, the clean-water pipe transmits the pressure of the clean-water column between the water surface and the upper piston body to the lower surface of the upper piston body;

S2. with the increase of sediment mass, the pressure difference between the upper and lower sides of the upper piston body in the vertical pipe becomes larger, the upper piston body slides downward along the vertical pipe under the action of sediment pressure until it reaches the lower piston body; the sediment continues to deposit, and the upper piston body and the lower piston body slide downward together; when the sediment mass in the normal distributional funnel increases to the threshold $M_1$ (H), the force of the upper piston body reaches the set threshold $Mp=\eta M_1$ (H), and the lower piston body reaches the bottom of the vertical pipe, wherein, $\eta$ is set according to the ratio of the volume of the upper deposition volume $\pi R^2 h_{max}$ of the upper piston body to the volume of the normal distributional funnel with the same top elevation, $M_1$ (H) is the force threshold of the upper piston body;

S3. the downward movement of the lower piston body drives the connecting rod to move downward, drives the first transmission gear to rotate, and further drives the second transmission gear to rotate, so as to drive the sediment flushing ball valve into rotation and to be gradually opened, the sediment accumulated in the normal distributional funnel is discharged from the reservoir to the downstream river channel through the smooth connecting pipe; at this time, the lower piston body is stuck between the two linkage trigger heads at the lower end, which limits the action of the lower piston body, and the draining sand ball valve is fully opened to complete sediment flushing continuously;

S4. in the process of sediment discharge in the normal distributional funnel, the pressure difference between the upper and lower sides of the upper piston body decreases, and the upper piston body gradually resets under the action of the upper spring, until it reaches the top of the vertical pipe, where the two linkage trigger heads at the top are triggered, and the two linkage trigger heads at the bottom are opened, so that the lower piston body is free from limits, and it can be reset under the action of the lower spring, driving the connecting rod to move upward along the vertical pipe, and driving the sediment flushing ball valve to be closed through the first transmission gear and the second transmission gear;

S5. Cycle step S1-step S4.

Preferably, in step S1, the buoyancy of the upper piston body is equal to:

$$F_S(t) = \rho\pi R^2 h(t),$$

the threshold $M_1(H)$ in step S2 is calculated by the following formula:

$$M_1(H) = 2(\rho_s - \rho)\sigma^2 H\left[1 - \left(1 - \frac{k}{\sqrt{2\pi}\,\sigma H}\right)\ln\left(1 - \frac{\sqrt{2\pi}\,\sigma H}{k}\right)\right]$$

where $\sigma$ is the variance parameter of the normal distributional funnel.

Compared with the existing technology, the present invention has the following beneficial effects:

1. The normal distributional funnel and the inverse hyperbolic tangent pipe have the advantage of having arbitrary order of smoothness, the smooth connecting pipe is connected to the normal distributional funnel and the inverse hyperbolic tangent pipe is connected to the inverse hyperbolic tangent pipe, so that the derivatives of the connecting part exists, so as to ensure that the whole sediment-discharge channel is smooth, greatly reducing the sediment discharge resistance and reducing the possibility of siltation, and realizing the automatic and rapid discharge of sediment in the reservoir under the action of gravitational force.
2. The fine sediment of the reservoir is discharged to the downstream river channel, which reduces the clean water erosion and the habitat destruction, increases the biogenic materials in the downstream river channel, improves the ecological environment of the river, and brings great economic and ecological benefits.
3. The pressure difference between the accumulated sediment and the clean water is used as the driving force. When the pressure difference reaches the control threshold, namely when the normal distributional funnel is filled with sediment, the transmission device is driven to open the sediment flushing ball valve to discharge the accumulated sediment with a sediment concentration of up to 500-1600 kg/m$^3$. Compared with the density flow sediment discharge, it greatly increases the sediment discharge efficiency and significantly saves the water resources required for sediment discharge to increase the hydropower generation. In comparison to the electric drive, the pressure difference of the muddy water, as the power source of the sediment flushing control system, significantly saves energy, and can avoid the potential safety hazards caused by underwater electric power consumption.
4. The automatic and effective discharge of suspended sediment in the downstream of the reservoir not only can maintain the reservoir capacity for a long time or achieve sustainable utilization of the reservoir, but also greatly save energy and water resources, and significantly increase the efficiency of sediment discharge and the amount of hydropower.

A further detailed description of the technical scheme of the invention is given below through drawings and embodiments.

Wherein, 1. sediment flushing funnel; 2. smooth connecting pipe; 3. sediment flushing pipe; 4. trigger-control mechanism; 41. vertical pipe; 42. upper piston assemblies; 421. upper piston body; 422. upper spring; 43. lower piston assemblies; 431. lower piston body; 432. lower spring; 44. connecting rod; 45. first transmission gear; 46. the second transmission gear; 47. linkage trigger head; 5. sediment flushing ball valve; 6. clean-water pipe; 7. dam.

DETAILED DESCRIPTION OF THE EMBODIMENTS

The following will further describe the invention in combination with the attached diagram. It should be noted that this embodiment is based on this technical scheme, and gives a detailed implementation method and specific operation process, but the protection scope of the invention is not limited to this embodiment.

Figure 1:
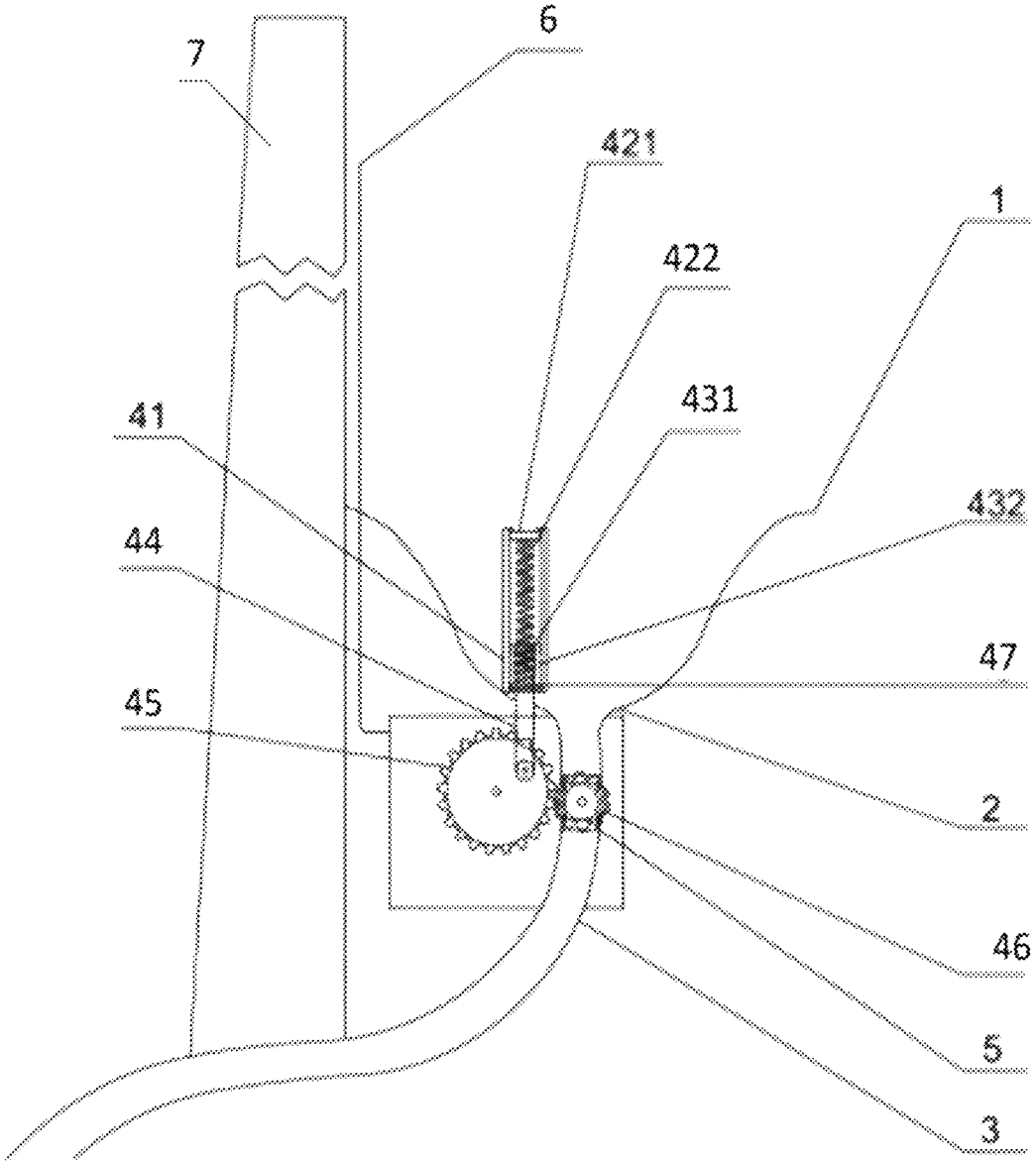
FIG. 1 is an assembly drawing of the present invention.
Figure 2:
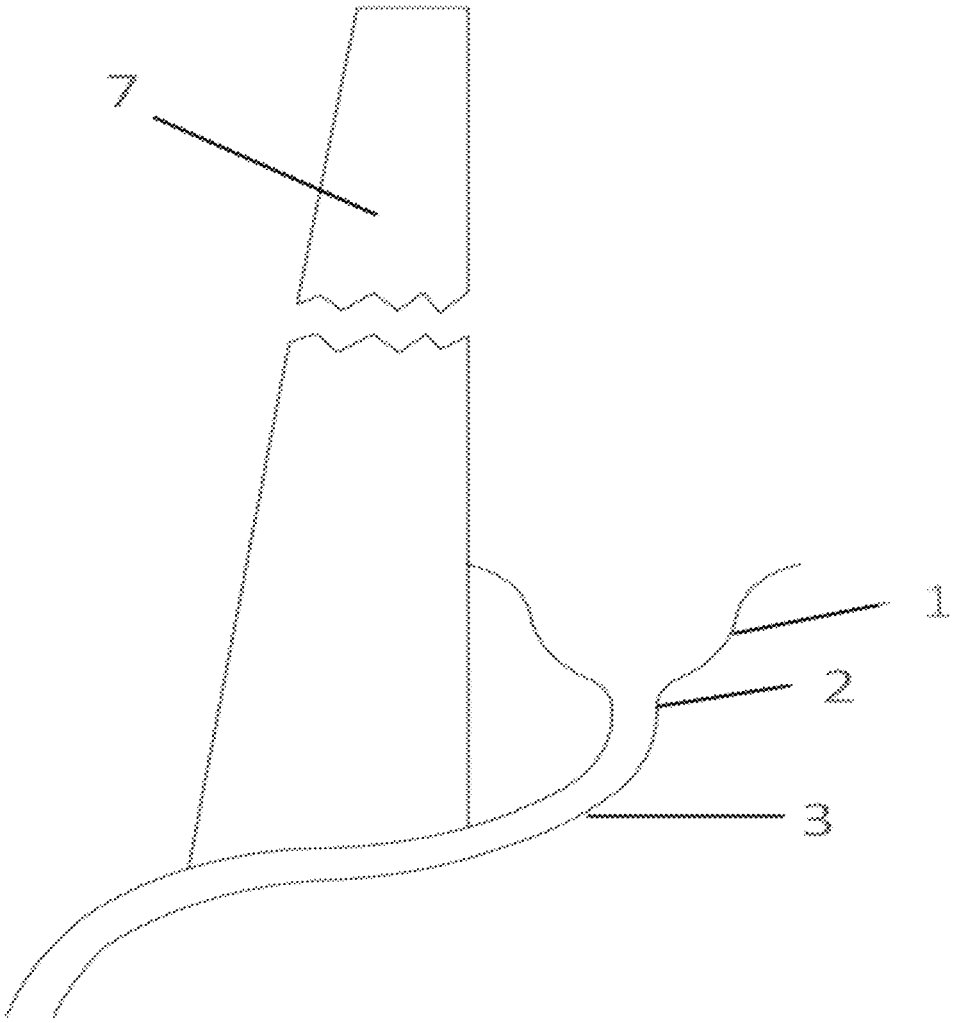
FIG. 2 is a front view of the sediment flushing funnel-smooth connecting pipe-desilting pipe of the present invention.
Figure 3:
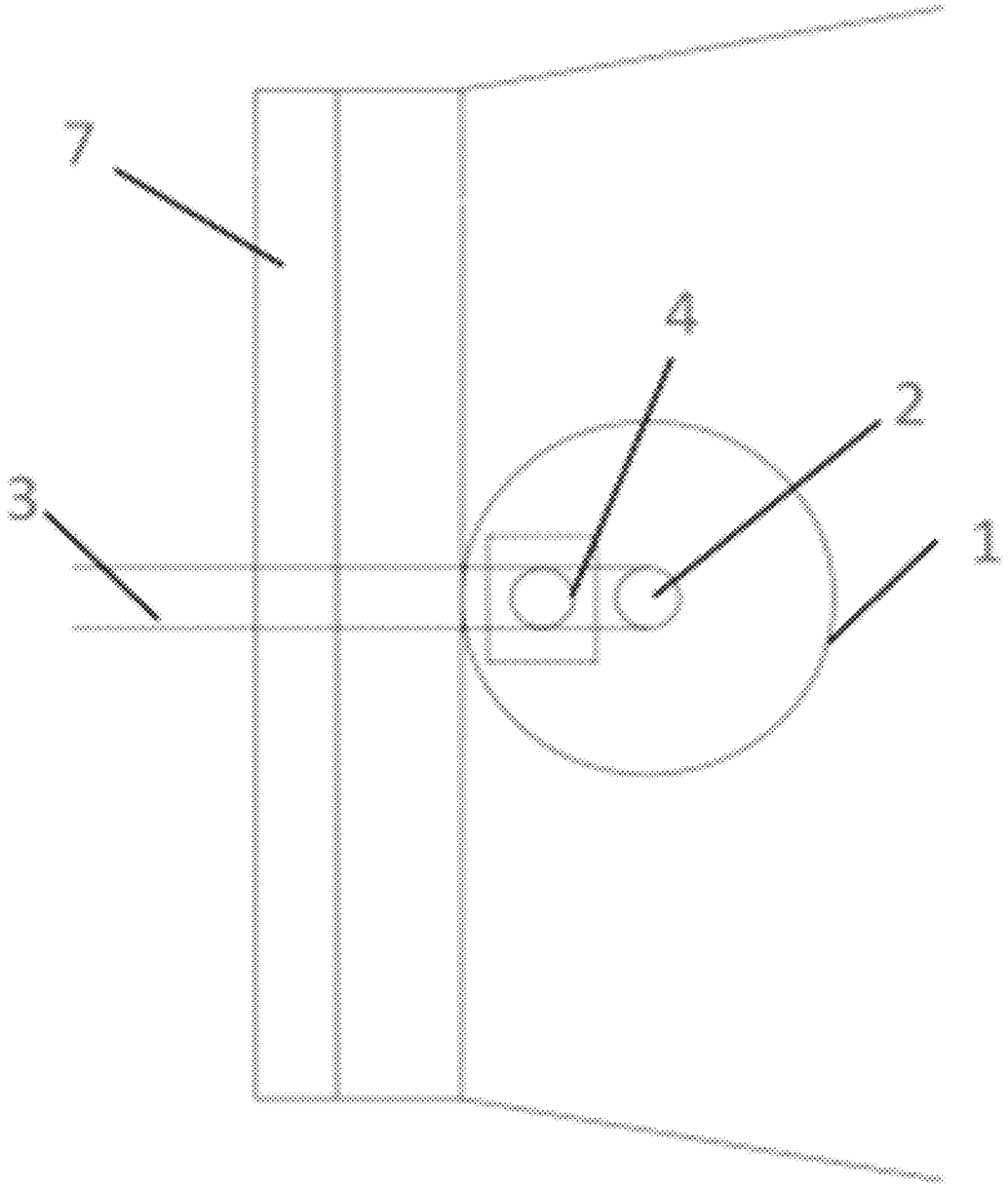
FIG. 3 is a top view of the sediment flushing funnel-smooth connecting pipe-desilting pipe of the present invention.
Figure 4:
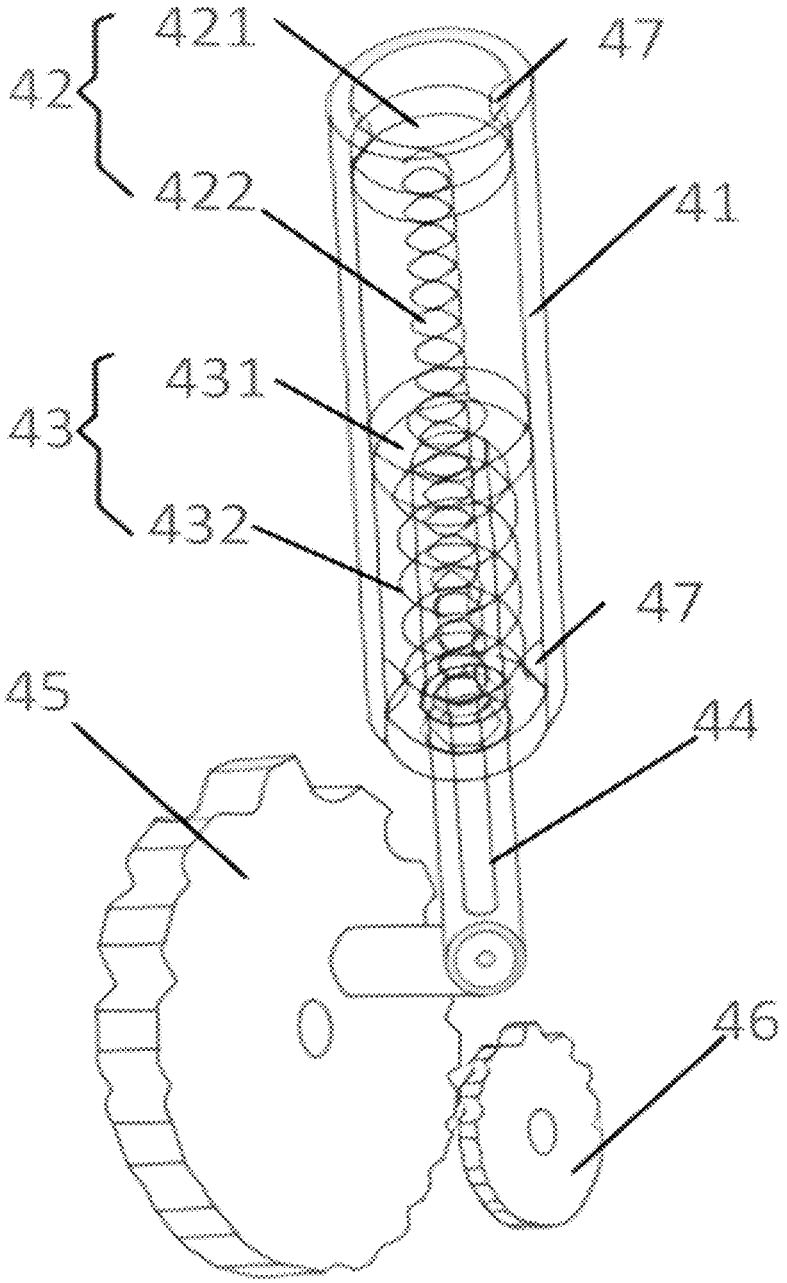
FIG. 4 is a schematic diagram of the trigger-control mechanism of the present invention.
Figure 5:
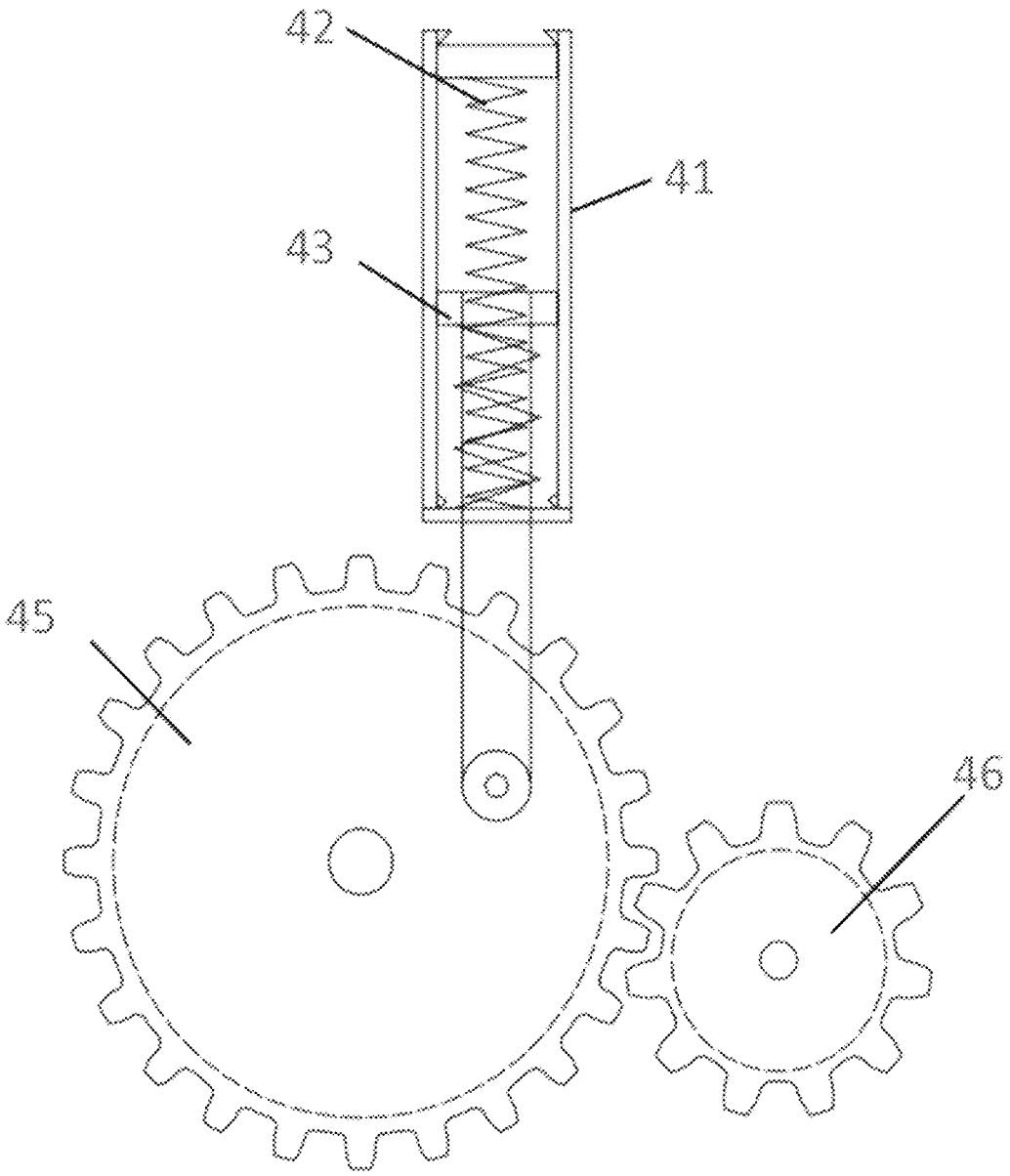
FIG. 5 is a front view of the trigger-control mechanism of the present invention.
Figure 6:
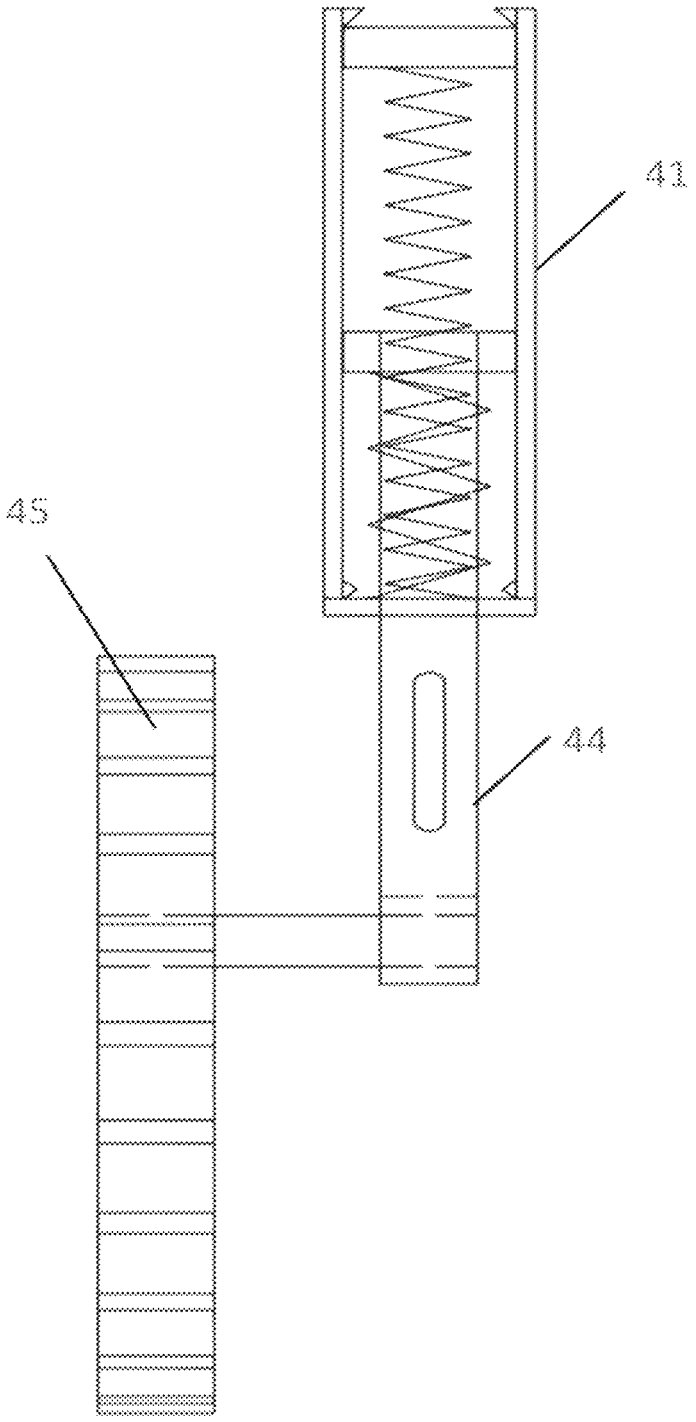
FIG. 6 is a side view of the trigger-control mechanism of the present invention.
Figure 7:
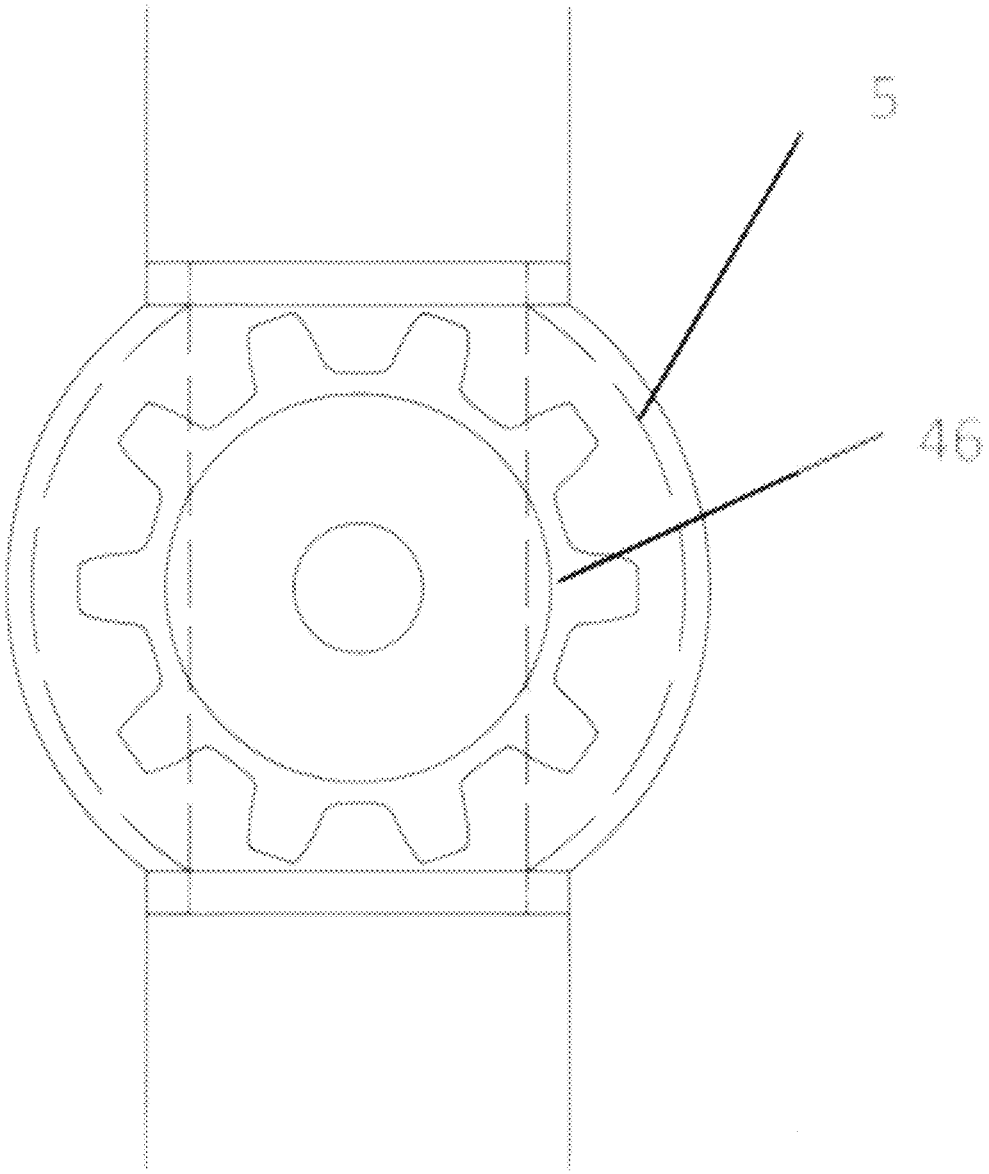
FIG. 7 is a front view of the sediment flushing ball valve of the present invention.

FIG. 1 is an assembly drawing of the present invention; FIG. 2 is a front view of the sediment flushing funnel-smooth connecting pipe-sediment flushing pipe of the present invention; FIG. 3 is a top view of the sediment flushing funnel-smooth connecting pipe-sediment flushing pipe of the present invention; FIG. 4 is a schematic diagram of the trigger-control mechanism of the present invention; FIG. 5 is a front view of the trigger-control mechanism of the present invention; FIG. 6 is a side view of the trigger-control mechanism of the present invention; FIG. 7 is a front view of the sediment flushing ball valve of the present invention, as shown in FIG. 1-FIG. 7, a smooth automatic reservoir sediment flushing device, which includes a sediment flushing funnel 1 set at the bottom of the reservoir dam 7 and a sediment flushing pipe 3 connected to the bottom of the sand collection funnel 1 by a smooth connecting pipe 2 at one end, the other end of the sediment flushing pipe 3 passes through the dam 7 horizontally and connects with the downstream river channel;

a trigger-control mechanism 4 is set inside the sediment flushing funnel 1, and a sediment flushing ball valve 5 connected with the trigger-control mechanism 4 is arranged in the sediment flushing pipe 3, in this implementation, the sediment flushing ball valve 5 is set at the entrance of the sediment flushing pipe 3;

Preferably, the trigger-control mechanism 4 includes a vertical pipe 41 set on the inner wall of the sediment flushing funnel 1 and an upper piston assembly 42 and a lower piston assembly 43 set inside the vertical pipe 41, capable of vertically slidingn, the lower piston assembly 43 is connected to the top of the connecting rod 44, the bottom end of the connecting rod 44 passes through the vertical pipe 41 and is connected eccentrically with a first transmission gear 45, the first transmission gear 45 and a second transmission gear 46 are meshed, and the second transmission gear 46 is linked to the sediment flushing ball valve 5;

the bottom end of the vertical pipe 41 is connected with the bottom end of the clean-water pipe 6, and the top end of the clean-water pipe 6 is located in the clean water area of the reservoir;

the height of the vertical pipe 41's top is lower than the height of the sediment flushing funnel's top, which ensures that the pressure on the upper piston body 421 is equal to the mud column of the same height in the normal distributional funnel.

Preferably, the upper piston assemblies 42 include the upper piston body 421 and the upper spring 422 located between the upper piston body 421 and the inner wall of the sediment flushing funnel 1; a sealing ring is arranged between the upper piston body 421 and the inner wall of the vertical pipe 41, which is used to keep the upper sediment of the upper piston body 421 separate from the clean water below, so that the pressure difference of the upper piston body 421 is equal to the underwater gravity of the sediment, and the force of the upper spring 422 and the lower spring 432 is reduced;

the lower piston assemblies 43 include the lower piston body 431 set below the upper piston body 421 and the lower spring 432 located between the lower piston body 431 and the inner wall of the sediment flushing funnel 1;

the upper spring 422 is inserted into the lower spring 432 after passing through the center of the lower piston body 431.

3. the smooth automatic device for reservoir sediment flushing according to claim 2, wherein the transmission ratio $I_R$ of the first transmission gear and the second transmission gear is determined by the following formula:

$$I_R = \frac{2}{\pi} \arccos\left[\frac{h^2 - 2Lh}{2r(L + r - h)} + 1\right]$$

wherein, h is the set height of the lower piston body, L is the length of the connecting rod, r is the distance from the connecting rod to the center of the first transmission gear, $z_1$ is the number of teeth of the first transmission gear, and $z_2$ is the number of teeth of the second transmission gear; at the time that the piston body in the vertical pipe sliding down a distance h to the bottom and driving the first transmission gear rotation to rotate an angle α, the gear transmission ratio is $$I_R = \frac{2\alpha}{\pi},$$

so that the rotation angle of the sediment flushing ball valve equal to π/2 or 90°;

when the lower piston body 431 slides downward in the vertical pipe 41 to the bottom, it drives the first transmission gear 45 to rotate an angle $\alpha_1$, where the relation between $\alpha_1$, the sliding height h of the lower piston body 431, the length L of the connecting rod 44, and the distance r between the end point of the connecting rod 44 and the center of the first transmission gear 45 is described as:

$$\cos\alpha_1 = \frac{r^2 + (L + r - h)^2 - L^2}{2r(L + r - h)} = \frac{h^2 - 2Lh}{2r(L + r - h)} + 1$$

from which a new formula is deduced:

$$\alpha_1 = \arccos\left[\frac{h^2 - 2Lh}{2r(L + r - h)} + 1\right]$$

the relation between the first gear rotation angle $\alpha_1$ and the second gear rotation angle $\alpha_2$ is:

$$\alpha_2 = \frac{z_2}{z_1}\alpha_1 = \frac{z_2}{z_1} \arccos\left[\frac{h^2 - 2Lh}{2r(L + r - h)} + 1\right]$$

wherein, $\alpha_2$ is the rotation angle of the sediment flushing ball valve 90°.

Preferably, the elastic force $F_S(t)$ of the upper spring 42 is equal to the underwater gravity of the sediment in the vertical pipe, that is:

$$F_S(t) = (\rho_S - \rho)\pi R^2 h(t)$$

wherein, R is the internal radius of the vertical pipe 41 or the radius of the upper piston body 421; h(t) is the deposition above the surface of the upper piston body 421, and it is a function of time t;

the maximum elastic force that the upper spring 422 can withstand is:

$$F_{Smax} = k(\rho_S - \rho)\pi R^2 h_{max}$$

wherein, k is a parameter of the normal distributional funnel, set to be 1.1~1.2, $h_{max}$ is approximately equal to H, $\rho_S$ is the density of accumulated sediment. $\rho$ is the density of water, and H is the height of the mud surface from the bottom of the funnel.

Preferably, linkage trigger heads that are capable of horizontally sliding are installed symmetrically at the upper end and the lower end of the vertical pipe 41, and the linkage trigger heads on the same side of the upper and lower ends are connected by a linkage rod;

there is a limit allowance suitable for the upper piston body 421 between the two linkage trigger heads 47 at the top, and there is a limit allowance suitable for the lower piston body 431 between the two linkage trigger heads 47 at the bottom;

an extrusion spring is set between the linkage trigger head 47 and the vertical pipe 41.

Preferably, the sediment flushing funnel 1 is a normal distributional funnel, and the normal distributional funnel is formed by rotating a concave normal-distribution curve around the axis of symmetry;

the sediment flushing pipe 3 is an inverse hyperbolic tangent pipe, and the central curve of the inverse hyperbolic tangent pipe is an inverse hyperbolic tangent curve.

Both the normal distributional funnel and the inverse tangent pipe have arbitrary order of derivatives and have arbitrary degree of smoothness.

Preferably, the top of the smooth connecting pipe 2 is tangent to the bottom of the normal distributional funnel, and the bottom of the smooth connecting pipe 2 is tangent to the top of the inverse hyperbolic tangent pipe;

the smooth connection pipe 2 adopts the following design:

in the normal distributional funnel longitudinal section y=0, denote the single variable normal distribution corresponding to the normal distributional funnel as z=h(x), and the function form corresponding to the curve at the entrance of the inverse hyperbolic tangent pipe as z=g(x), wherein, the normal distributional funnel surface and the entrance of the inverse hyperbolic tangent pipe are rotationally symmetrical with respect to the ordinate z; the slope at the normal distributional funnel outlet $(x_0, 0, z_0)$ is denoted as $h'(x_0)$, the slope at the entrance of the inverse hyperbolic tangent channel $(x_1, 0, z_1)$ is $g'(x_1)$, wherein $|x_0|>|x_1|$, let $$C(x) = z_0 + h'(x_0)(x - x_0) + \beta_2(x - x_0)^2 + \beta_3(x - x_0)^3$$

wherein, $\beta_2$ and $\beta_3$ are the polynomial coefficients depending on the slopes $h'(x_0)$ and $g'(x_1)$, respectively:

$$\beta_2 = \frac{3(z_1 - z_0) - (x_1 - x_0)(2h'(x_0) + g'(x_1))}{(x_1 - x_0)^2}$$

$$\beta_3 = \frac{(h'(x_0) + g'(x_1))(x_1 - x_0) + 2(z_0 - z_1)}{(x_1 - x_0)^3}$$

The pipe body of the smooth connecting pipe is the rotationally symmetric surface z=C(x, y) obtained by rotating the curve C(x).

in this embodiment, the selection of design parameters such as $z_0$, $z_1$, $h'(x_0)$ should meet certain restrictive conditions, for example, under the assumption of $\beta_3 \geq 0$, it should satisfy:

$$\beta_2^2 < 3h'(x_0)\beta_3$$

or $$\begin{cases} \beta_2^2 \gg |3h'(x_0)\beta_3| \\ |h'(x_0)| \ll \beta_3 \end{cases}$$

A smooth automatic method for reservoir sediment flushing includes the following steps:

S1. the reservoir sediment drops into a normal funnel before reaching the front of the dam 7 and meanwhile, the sediment enters the vertical pipe 41 and acts on the upper surface of the upper piston body 421, the clean-water pipe 6 transmits the pressure of the clean-water column between the water surface and the upper piston body 421 to the lower surface of the upper piston body 421;

S2. with the increase of sediment mass, the pressure difference between the upper and lower sides of the upper piston body 421 in the vertical pipe 41 becomes larger, the upper piston body 421 slides downward along the vertical pipe 41 under the action of sediment pressure until it reaches the lower piston body 431, the sediment continues to deposit, and the upper piston body 421 and the lower piston body 431 slide downward together; when the sediment mass in the normal distributional funnel increases to the threshold $M_1$ (H), the force of the upper piston body 421 reaches the set threshold $Mp=\eta M_1$ (H), and the lower piston body reaches the bottom of the vertical pipe, wherein, $\eta$ is set according to the ratio of the volume of the upper deposition volume $\pi R^2 h_{max}$ of the upper piston body to the volume of the normal distributional funnel with the same top elevation, $M_1$ (H) is the force threshold of the upper piston body 421;

S3. the downward movement of the lower piston body 431 drives the connecting rod 44 to move downward, drives the first transmission gear 45 to rotate, and further drives the second transmission gear 46 to rotate, so as to drive the sediment flushing ball valve 5 into rotation and to be gradually opened, the sediment accumulated in the normal distributional funnel is discharged from the reservoir to the downstream river channel through the smooth connecting pipe 2; at this time, the lower piston body 431 is stuck between the two linkage trigger heads 47 at the lower end, which limits the action of the lower piston body 431, and the draining sand ball valve 5 is fully opened to complete sediment flushing continuously;

S4. in the process of sediment discharge in the normal distributional funnel, the pressure difference between the upper and lower sides of the upper piston body 421 decreases, and the upper piston body 421 gradually resets under the action of the upper spring 422, until it reaches the top of the vertical pipe 41, where the two linkage trigger heads 47 at the top are triggered; the two linkage trigger heads 47 at the bottom are opened, so that the lower piston body 431 is free from limits, and it can be reset under the action of the lower spring 432, driving the connecting rod 44 to move upward along the vertical pipe 41, and driving the sediment flushing ball valve 5 to be closed through the first transmission gear 45 and the second transmission gear 46;

S5. Cycle step S1-step S4.

Preferably, in step S1, the buoyancy of the upper piston body 421 is equal to:

$$F_S(t) = \rho\pi R^2 h(t),$$

the threshold $M_1(H)$ in step S2 is calculated by the following formula:

$$M_1(H) = 2(\rho_s - \rho)\sigma^2 H\left[1 - \left(1 - \frac{k}{\sqrt{2\pi}\,\sigma H}\right)\ln\left(1 - \frac{\sqrt{2\pi}\,\sigma H}{k}\right)\right]$$

where $\sigma$ is the variance parameter of the normal distributional funnel.

Therefore, the present invention adopts the above-mentioned smooth automatic device and method for reservoir sediment flushing, which can open the sediment flushing ball valve when the mass of sediment in the sediment flushing funnel, reaches the set threshold, and the sediment is discharged into the downstream river channel through the smooth connecting pipe and sediment flushing pipe under the action of gravitational force, so as to realize the automatic reservoir sediment flushing, and has the advantages of high efficiency, being energy saving and water resources saving.

What is claimed is:

1. A smooth automatic device for reservoir sediment flushing, comprising a sediment flushing funnel set at bottom of a reservoir dam and a sediment flushing pipe, one end of the sediment flushing pipe is smoothly connected to bottom of the sediment flushing funnel through a smooth connecting pipe, and an other end of the sediment flushing pipe is horizontally connected to a downstream river channel after passing through the reservoir dam;

a trigger-control mechanism is installed inside the sediment flushing funnel, and a sediment flushing ball valve connected with the trigger-control mechanism is installed inside the sediment flushing pipe;

wherein the trigger-control mechanism comprises: a vertical pipe set on an inner wall of the sediment flushing funnel, and an upper piston assembly and a lower piston assembly set inside the vertical pipe, capable of vertically sliding; the lower piston assembly is connected to top of a connecting rod, bottom of the connecting rod passes through the vertical pipe and is connected eccentrically with a first transmission gear, the first transmission gear and a second transmission gear are meshed, and the second transmission gear is linked to the sediment flushing ball valve;

bottom of the vertical pipe is connected with bottom of a clean-water pipe, and top of the clean-water pipe is located in a clean-water area of a reservoir; and a height of top of the vertical pipe is lower than a height of top of the sediment flushing funnel;

wherein the upper piston assembly comprises: an upper piston body and an upper spring arranged between the upper piston body and the inner wall of the sediment flushing funnel; a sealing ring is arranged between the upper piston body and an inner wall of the vertical pipe, and the sealing ring is used to keep sediment above the upper piston body separate from clean water below the upper piston body, so that a pressure difference of the upper piston body is equal to an underwater weight of the sediment;

the lower piston assembly comprises: a lower piston body set below the upper piston body and a lower spring located between the lower piston body and the inner wall of the sediment flushing funnel; and the upper spring is inserted into the lower spring after passing through a center of the lower piston body.

2. The smooth automatic device for reservoir sediment flushing according to claim 1, wherein a transmission ratio $I_R$ of the first transmission gear and the second transmission gear is determined by following formula:

$$I_R = \frac{2}{\pi}\arccos\left[\frac{h^2 - 2Lh}{2r(L + r - h)} + 1\right]$$

wherein, h is a set height of the lower piston body, L is a length of the connecting rod, r is a distance from the connecting rod to a center of the first transmission gear, $z_1$ is a number of teeth of the first transmission gear, and $z_2$ is a number of teeth of the second transmission gear; when the lower piston body slides downward in the vertical pipe for a distance h to the bottom of the vertical pipe, the first transmission gear is driven to rotate an angle $\alpha$, and a gear transmission ratio is $$I_R = \frac{2\alpha}{\pi},$$

so that a rotation angle of the sediment flushing ball valve is equal to $\pi/2$ or 90°;

when the lower piston body slides downward in the vertical pipe for the distance h to the bottom of the vertical pipe, the first transmission gear is driven to rotate an angle $\alpha_1$, wherein a relation among $\alpha_1$, a sliding height h that the lower piston body slides, the length L of the connecting rod, and the distance r from the connecting rod to the center of the first transmission gear is expressed as $$\cos\alpha_1 = \frac{r^2 + (L + r - h)^2 - L^2}{2r(L + r - h)} = \frac{h^2 - 2Lh}{2r(L + r - h)} + 1$$

from which a new formula is derived:

$$\alpha_1 = \arccos\left[\frac{h^2 - 2Lh}{2r(L + r - h)} + 1\right]$$

a relation between a rotation angle $\alpha_1$ of the first transmission gear and a rotation angle $\alpha_2$ of the second transmission gear is expressed as:

$$\alpha_2 = \frac{z_2}{z_1}\alpha_1 = \frac{z_2}{z_1}\arccos\left[\frac{h^2 - 2Lh}{2r(L + r - h)} + 1\right]$$

wherein, $\alpha_2$ is the rotation angle of the sediment flushing ball valve and is equal to 90°.

3. The smooth automatic device for reservoir sediment flushing according to claim 2, wherein an elastic force $F_S(t)$ of the upper spring is equal to a submerged weight of sediment in the vertical pipe, which is expressed as:

$$F_S(t) = (\rho_S - \rho)\pi R^2 h(t)$$

wherein, R is an internal radius of the vertical pipe or a radius of the upper piston body; h(t) is a deposition above surface of the upper piston body and is a function of time t;

a maximum elastic force that the upper spring can withstand is expressed as:

$$F_{Smax} = k(\rho_S - \rho)\pi R^2 h_{max}$$

wherein, k is a parameter of a normal distributional funnel, set to be 1.1~1.2, $h_{max}$ is approximately equal to H, $\rho_S$ is a density of accumulated sediment, ρ is a density of water, and H is a height from a mud surface to the bottom of the sediment flushing funnel.

4. The smooth automatic device for reservoir sediment flushing according to claim 3, wherein linkage trigger heads that are capable of horizontally sliding are installed symmetrically at the top and the bottom of the vertical pipe, and the linkage trigger heads on a same side of the top and bottom of the vertical pipe are connected by a linkage rod;

a limit allowance suitable for the upper piston body is provided between two linkage trigger heads installed at the top of the vertical pipe, and a limit allowance suitable for the lower piston body is provided between two linkage trigger heads installed at the bottom of the vertical pipe;

an extrusion spring is set between the vertical pipe and each of the linkage trigger heads.

5. The smooth automatic device for reservoir sediment flushing according to claim 4, wherein the sediment flushing funnel is a normal distributional funnel, and the normal distributional funnel is formed by rotating a concave normal-distribution curve around an axis of symmetry;

the sediment flushing pipe is an inverse hyperbolic tangent pipe, and a central curve of the inverse hyperbolic tangent pipe is an inverse hyperbolic tangent curve;

both the normal distributional funnel and the inverse hyperbolic tangent pipe have arbitrary order of derivatives and have arbitrary degree of smoothness.

6. The smooth automatic device for reservoir sediment flushing according to claim 5, wherein top of the smooth connecting pipe is tangent to bottom of the normal distributional funnel, and bottom of the smooth connecting pipe is tangent to top of the inverse hyperbolic tangent pipe;

the smooth connecting pipe adopts the following design:

in a longitudinal section y=0 of the normal distributional funnel, a single variable normal distribution form corresponding to the normal distributional funnel is denoted as z=h(x), and a function corresponding to a curve at an entrance of the inverse hyperbolic tangent pipe is denoted as z=g(x), wherein, a surface of the normal distributional funnel and the entrance of the inverse hyperbolic tangent pipe are rotationally symmetrical with respect to an ordinate z; a slope of an outlet $(x_0, 0, z_0)$ at the normal distributional funnel is denoted as $h'\text{-}(x_0)$, a slope at the entrance $(x_1, 0, z_1)$ of the inverse hyperbolic tangent channel is denoted as $g'\text{-}(x_1)$, wherein $|x_0|>|x_1|$, let $$C(x) = z_0 + h'(x_0)(x - x_0) + \beta_2(x - x_0)^2 + \beta_3(x - x_0)^3$$

wherein, $\beta_2$ and $\beta_3$ are polynomial coefficients depending on the slopes $h'\text{-}(x_0)$ and $g'\text{-}(x_1)$, respectively:

$$\beta_2 = \frac{3(z_1 - z_0) - (x_1 - x_0)(2h'(x_0) + g'(x_1))}{(x_1 - x_0)^2}$$

$$\beta_3 = \frac{(h'(x_0) + g'(x_1))(x_1 - x_0) + 2(z_0 - z_1)}{(x_1 - x_0)^3}$$

wherein a pipe body of the smooth connecting pipe is a rotationally symmetric surface z=C(x, y) corresponding to a curve C(x).

7. A smooth automatic method for reservoir sediment flushing, which is based on the smooth automatic method for reservoir sediment flushing according to claim 5, comprising:

step s1: reservoir sediment is dropped into the normal distributional funnel before reaching the reservoir dam, wherein the reservoir sediment enters the vertical pipe and acts on an upper surface of the upper piston body, the clean-water pipe transmits a pressure of a clean-water column between a surface of water and the upper piston body, to a lower surface of the upper piston body;

step s2: with an increase in sediment mass, a pressure difference between top and bottom of the upper piston body in the vertical pipe becomes larger, the upper piston body slides downward along the vertical pipe under an action of reservoir sediment pressure until the upper piston body reaches the lower piston body; the reservoir sediment continues to be deposited, and the upper piston body and the lower piston body slide downward together; when the sediment mass in the normal distributional funnel increases to a threshold $M_1\text{-}(H)$, a force experienced by the upper piston body reaches a set threshold $M_p=\eta M_1(H)$, and the lower piston body reaches the bottom of the vertical pipe, wherein, η is set according to a ratio of a volume of a deposition volume $\pi R^2 h_{max}$ above the upper piston body to a volume of the normal distributional funnel with a same top elevation, $M_1\text{-}(H)$ is a force threshold of the upper piston body;

step s3: downward movement of the lower piston body drives the connecting rod to move downward to drive the first transmission gear to rotate, and further to drives the second transmission gear to rotate, so as to drive the sediment flushing ball valve into rotation and to be gradually opened, sediment accumulated in the normal distributional funnel is discharged from the reservoir to the downstream river channel through the smooth connecting pipe; at this moment, the lower piston body is stuck between the two linkage trigger heads installed at the bottom of the vertical pipe, which limits an action of the lower piston body, and the sediment flushing ball valve is fully opened to complete sediment flushing continuously;

step s4: in a process of sediment discharge in the normal distributional funnel, the pressure difference between the top and bottom of the upper piston body decreases, and the upper piston body gradually resets under an action of the upper spring, when the upper piston body reaches the top of the vertical pipe, the two linkage trigger heads installed at the top of the vertical pipe are triggered; then the two linkage trigger heads installed at the bottom of the vertical pipe are opened, so that the lower piston body is free from limits and can be reset under an action of the lower spring to drive the connecting rod to move upward along the vertical pipe, and to drive the sediment flushing ball valve to be closed through the first transmission gear and the second transmission gear; and step s5: step s1 to step s4 are cycled.

8. The smooth automatic method for reservoir sediment flushing according to claim 7, wherein in step s1, a buoyancy of the upper piston body is equal to $$F_S(t) = \rho\pi R^2 h(t),$$

and the threshold $M_1(H)$ in step s2 is calculated by following formula:

$$M_1(H) = 2(\rho_s - \rho)\sigma^2 H\left[1 - \left(1 - \frac{k}{\sqrt{2\pi}\,\sigma H}\right)\ln\left(1 - \frac{\sqrt{2\pi}\,\sigma H}{k}\right)\right]$$

wherein, $\sigma$ is a variance parameter of the normal distributional funnel.

* * * * *